US005303210A

United States Patent [19]

Bernstein

[11] Patent Number: 5,303,210

[45] Date of Patent: Apr. 12, 1994

[54] INTEGRATED RESONANT CAVITY ACOUSTIC TRANSDUCER

[75] Inventor: Jonathan Bernstein, Medfield, Mass.

[73] Assignee: The Charles Stark Draper Laboratory, Inc., Cambridge, Mass.

[21] Appl. No.: 968,285

[22] Filed: Oct. 29, 1992

[51] Int. Cl.[5] ..... H04R 19/00

[52] U.S. Cl. ..... 367/181; 381/174

[58] Field of Search ..... 367/162, 176, 174, 171, 367/181; 381/191, 174; 29/25.42

[56] References Cited

U.S. PATENT DOCUMENTS

| | | | |
|---|---|---|---|
| 4,184,094 | 1/1980 | Kopel | 367/152 |
| 4,211,948 | 7/1980 | Smith et al. | 367/152 |
| 4,414,482 | 11/1983 | Lewis et al. | 310/334 |
| 4,429,246 | 1/1984 | Miyajima | 310/313 B |
| 5,007,030 | 4/1991 | Sullivan et al. | 367/176 |
| 5,146,435 | 9/1992 | Bernstein | 367/181 |

*Primary Examiner*—Daniel T. Pihulic
*Attorney, Agent, or Firm*—Joseph S. Iandiorio

[57] ABSTRACT

An integrated resonant cavity acoustic transducer includes a substrate chip having a cavity; a movable plate electrode; means for resiliently mounting the movable plate electrode across the cavity in the substrate chip; and a perforated electrode spaced from the movable plate electrode and mounted across the cavity in the substrate chip; the cavity has a depth from the movable electrode to the back wall of the cavity of approximately one quarter wavelength of the acoustic energy for enabling constructive interference between the primary and reflected acoustic wave for maximizing the displacement of said movable electrode.

16 Claims, 2 Drawing Sheets

INTEGRATED RESONANT CAVITY ACOUSTIC TRANSDUCER

FIELD OF INVENTION

This invention relates to an integrated resonant cavity acoustic transducer, and more particularly to such a transducer useful as a microphone, hydrophone or loudspeaker for example.

BACKGROUND OF INVENTION

Conventional acoustic transducers for use as microphones, hydrophones, loudspeakers and the like are generally formed of discrete components which must be assembled individually. These conventional acoustic transducers must then be assembled into arrays for high frequency, high resolution acoustic imaging such as ultrasonic imaging, sonar, medical ultrasound, ultrasonic ranging and fetal heart monitoring. These devices tend to be large, bulky, heavy and low in sensitivity, especially at high frequencies.

SUMMARY OF INVENTION

It is therefore an object of this invention to provide an improved resonant cavity acoustic transducer.

It is a further object of this invention to provide such an improved transducer which is formed wholly on a substrate chip.

It is a further object of this invention to provide such an improved transducer which is smaller, more compact, and simpler.

It is a further object of this invention to provide such an improved transducer which can be formed with an integrated electronic circuit all on the same substrate chip.

It is a further object of this invention to provide such an improved transducer which is more sensitive and efficient at higher frequencies.

It is a further object of this invention to provide such an improved transducer which uses a closed cavity rather than a through hole.

It is a further object of this invention to provide such an improved transducer which facilitates easy fabrication of arrays of such transducers.

The invention results from the realization that a truly efficient and sensitive yet small, simple and compact resonant cavity acoustic transducer can be effected by mounting the movable and perforated electrodes across a cavity in a substrate chip which cavity has a depth of approximately one quarter wavelength of the acoustic energy to be sensed or generated for enabling constructive interference between the primary and reflected acoustic waves for maximizing the displacement of the movable electrode and thus also the sensitivity of detection of, or the efficiency of generation of, the acoustic energy.

This invention features an integrated resonant cavity acoustic transducer including a substrate chip having a cavity. There is a movable plate electrode and means for resiliently mounting the movable plate electrode across the cavity in the substrate chip. A perforated electrode is spaced from the movable plate electrode and mounted across the cavity in the substrate chip. The cavity has a depth from the movable electrode to the back wall of the cavity of approximately one quarter wavelength of the acoustic energy for enabling constructive interference between the primary and reflected acoustic waves for maximizing the displacement of the movable electrode.

The transducer may be used as a microphone or hydrophone, in which case the constructive interference between the incoming and reflected acoustic waves maximizes displacement of the movable electrode and the sensitivity of the microphone or hydrophone. The transducer may also operate as a loudspeaker, in which case the constructive interference between the generated and reflected acoustic waves maximize the displacement of the movable electrode and the acoustic output.

In a preferred embodiment the means for resiliently mounting may include spring means for interconnecting the substrate chip and the movable plate electrode. The movable plate electrode and the substrate may be integrally formed and the means for resiliently mounting may include a flexible section of one or both of them. The substrate chip may be a silicon chip. The movable plate and the means for resiliently mounting may be made of silicon and may be integral with the silicon chip. The movable plate may be made of metal. The perforated electrode may be integral with the substrate chip and may be made of silicon and polycrystalline silicon. The substrate chip may include an integrated buffer amplifier circuit interconnected with the electrodes. The substrate chip may be mounted on the backing plate and the cavity may extend into the backing plate, or the cavity may end at the backing plate.

DISCLOSURE OF PREFERRED EMBODIMENT

Other objects, features and advantages will occur to those skilled in the art from the following description of a preferred embodiment and the accompanying drawings, in which.

The integrated resonant cavity of acoustic transducer of this invention may be accomplished with a substrate chip having a cavity in it. The substrate chip may be made of silicon or any other material such as germanium, gallium arsenide, other semiconductors, or metals. There is a movable plate electrode and some means for resiliently mounting the movable plate electrode across the cavity in the substrate. The means for resiliently mounting may be independent springs or may be a webbing or membrane which is a part of the substrate chip or a part of the movable electrode. There is a perforated electrode spaced from the movable electrode and mounted across the cavity in the substrate chip. The perforated electrode is typically fixed. It may be bridging electrode fixed to the substrate chip. Conversely, the movable electrode can be implemented as a bridging structure and the perforated electrode can be implemented as a straight member. Importantly, the cavity has a depth from the movable electrode to the back wall of the cavity of approximately one quarter wavelength of the acoustic energy to be processed by the transducer. This enables constructive interference between the primary and reflected acoustic waves for maximizing the displacement of the movable electrode. If the electrode is driven by an applied voltage, then a loudspeaker or ultrasonic projector is effected with the result that the constructive interference between the generated and reflected acoustic wave maximizes the displacement of the movable electrode and thus the acoustic output. Alternatively, if the device is operated as a microphone or a hydrophone, the constructive interference between the incoming and reflected acoustic waves maximizes the displacement of the movable electrode and thus also maximizes the sensitivity of the microphone or hydrophone. The movable electrode may be mounted by means of independent springs, or the resilient mounting means may be a part of either the movable electrode or the substrate chip. Typically the substrate chip would be made out of silicon and so would the movable electrode and the interconnecting resilient membrane or sections. The perforated electrode might also be integral with the substrate chip and may be made of silicon or polycrystalline silicon. The substrate chip preferably includes an integrated buffer amplifier or similar circuit interconnected with the electrodes. The substrate chip may be mounted on a backing plate and the cavity may end at or extend into the backing plate.

Figure 1:
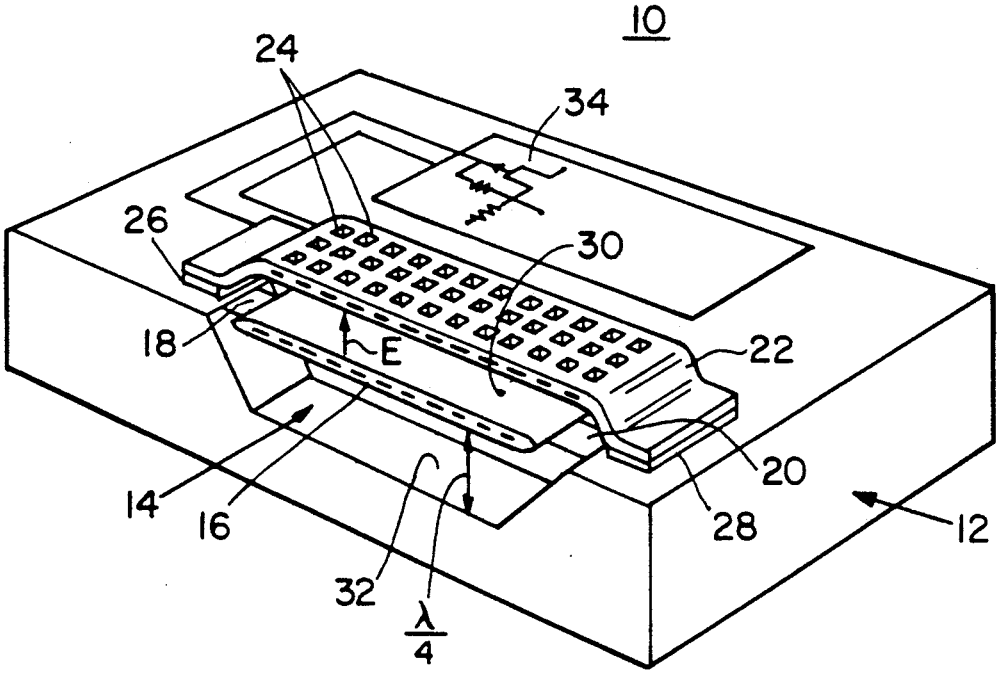
FIG. 1 is a three-dimensional diagrammatic view of an integrated resonant cavity acoustic transducer according to this invention.

There is shown in FIG. 1 an integrated resonant cavity acoustic transducer 10 according to this invention, including a silicon chip 12 having a cavity 14. Mounted across the cavity is a movable electrode 16 which may be made out of the same material as chip 12 or a different material including other semiconductors or metals. Electrode 16 is attached to chip 12 by means of resilient members 18 and 20. These may be independent springs or other resilient devices, or they may be made integral with either electrode 16 or chip 12, and also may be made of the same material as electrode 16 or chip 12. In one preferred construction, electrode 16, chip 12 and the resilient members 18 and 20 are all made of the same material, silicon, and are integral. When chip 12 is made of silicon or other suitable material, the associated buffer electronics 34 may be fabricated on the same chip. A perforated electrode 22 including perforations 24 is mounted on dielectric insulating pads 26 and 28 on chip 12. Electrode 22 is spaced from electrode 16 by gap 30. Although perforated fixed electrode 22 is shown in a bridging arrangement while movable electrode 16 is shown in a straight aligned mounting configuration, this is not a necessary limitation of the invention. The movable electrode could be arranged in a bridging construction and the perforated fixed electrode 22 could be mounted straight across in the manner presently shown in FIG. 1 for movable electrode 16. Cavity 14 is constructed so that its back wall 32 is approximately one quarter wavelength ($\lambda/4$) away from movable electrode 16. This permits the acoustic wave energy, whether being generated or being detected, to be maximized by the constructive interference of the primary and reflected acoustic waves in cavity 14 between back surface 32 and movable electrode 16.

Figure 2:
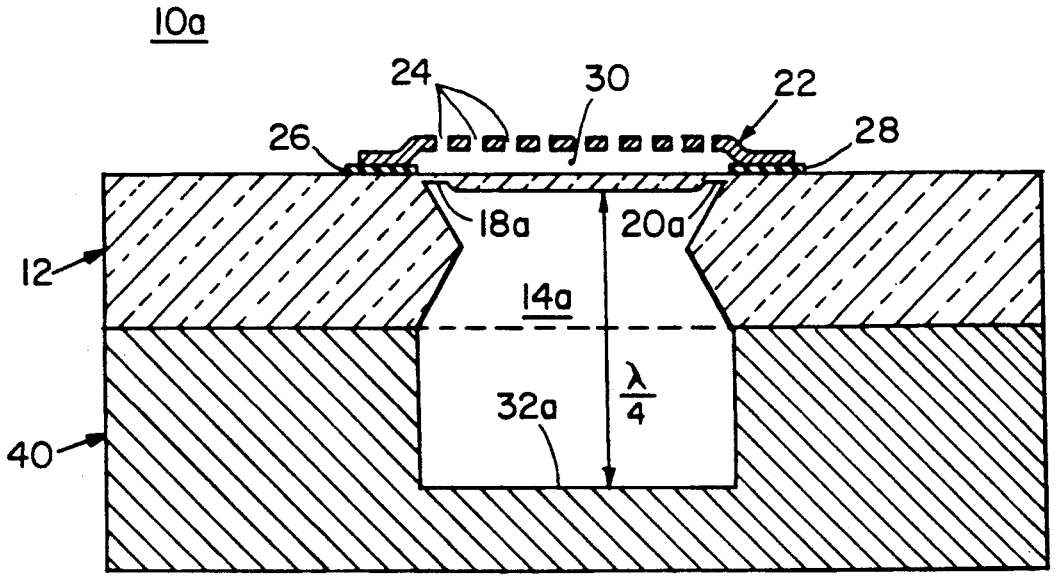
FIG. 2 is a side sectional view of a transducer similar to that shown in FIG. 1 in which the substrate chip is mounted on a backing plate and the cavity extends into the backing plate.

In an alternative construction, FIG. 2, silicon chip 12 is provided with a backing plate 40 which may be made of ceramic or metal for example. In this case the $\lambda/4$ depth of cavity 14*a* is attained by extending the cavity partially into backing plate 40. In FIG. 2 the resilient support means 18*a* and 20*a* are shown as an integral part of chip 12 and movable electrode 16.

Figure 4:
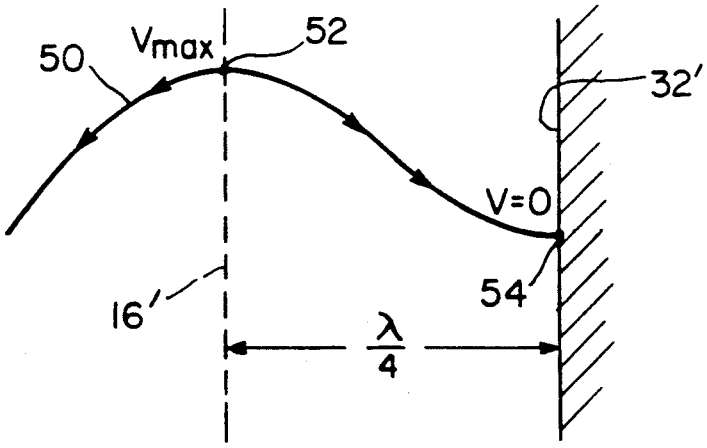
FIG. 4 is a graphical illustration of the resonant reinforcement of the acoustic wave in the cavity of the transducers of FIGS. 1–3.
Figure 3:
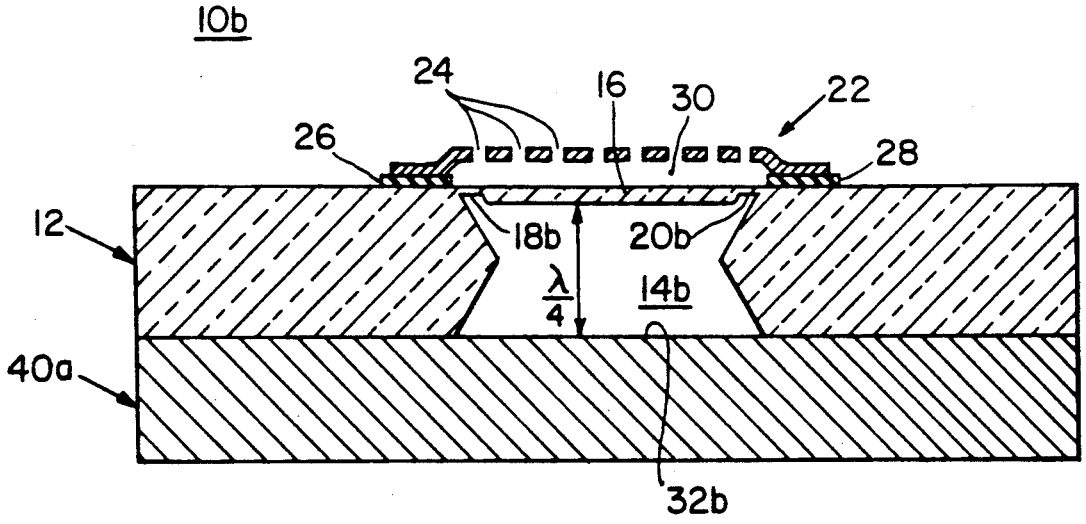
FIG. 3 is a view similar to FIG. 2 wherein the cavity ends at the backing plate.

Backing plate 40*a*, FIG. 3, may also be used to terminate cavity 14*b* by using the face of backing plate 40*a* as the back surface 32*b* of cavity 14*b*. The manner in which the constructive interference or reinforcement occurs is illustrated in FIG. 4, where the acoustic wave 50, incoming or generated, is shown with velocity at a maximum at dashed line 16' representing the movable electrode 16, the velocity of the acoustic wave decreases on either side of point 52 coinciding with line 16' representing movable to electrode 16. The velocity reaches zero at point 54 coinciding with the wave at line 32' representing the back wall 32 of cavity 14. The distance between lines 16' and 32' is one quarter wavelength, $\lambda/4$, so that the reflected wave exactly coincides with the incoming wave and thus completely reinforces it at point 52 where the velocity is a maximum through constructive interference, thereby making the generation and the detection of the acoustic waves at the resonant frequency extremely efficient.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. An integrated resonant cavity acoustic transducer, comprising:

a substrate chip having a cavity with a back wall;

a movable plate electrode;

means for resiliently mounting said movable plate electrode across said cavity in said substrate chip;

a perforated electrode spaced from said movable plate electrode and mounted across said cavity in said substrate chip; and said cavity having a depth from said movable electrode to the back wall of said cavity of approximately one quarter wavelength of an acoustic wave for enabling constructive interference between the primary and reflected acoustic waves for maximizing the displacement of said movable electrode.

2. The integrated resonant cavity acoustic transducer of claim 1 in which said means for resiliently mounting includes spring means interconnecting said subtrate chip and said movable plate electrode.

3. The integrated resonant cavity acoustic transducer of claim 1 in which said movable plate electrode and said substrate chip are integrally formed and said means for resiliently mounting includes a flexible section.

4. The integrated resonant cavity acoustic transducer of claim 1 in which said substrate chip is a silicon chip.

5. The integrated resonant cavity acoustic transducer of claim 4 in which said movable plate electrode and said means for resiliently mounting are made of silicon and are integral with said silicon chip.

6. The integrated resonant cavity acoustic transducer of claim 1 in which said movable plate electrode is made of metal.

7. The integrated resonant cavity acoustic transducer of claim 1 in which said perforated electrode is integral with said substrate chip.

8. The integrated resonant cavity acoustic transducer of claim 1 in which said perforated electrode is made of silicon.

9. The integrated resonant cavity crystal acoustic transducer of claim 1 in which said perforated electrode is made of polycrystalline silicon.

10. The integrated resonant cavity acoustic transducer of claim 1 in which said perforated electrode is made of metal.

11. The integrated resonant cavity acoustic transducer of claim 1 in which said substrate chip includes an integrated buffer amplifier circuit interconnected with said electrodes.

12. The integrated resonant cavity acoustic transducer of claim 1 in which said substrate chip is mounted on a backing plate and said cavity extends into said backing plate.

13. The integrated resonant cavity acoustic transducer of claim 1 in which said substrate chip is mounted on a backing plate and said cavity ends at said backing plate.

14. An integrated resonant cavity acoustic microphone, comprising:

a substrate chip having a cavity with a back wall;

a movable plate electrode;

means for resiliently maintaining said movable plate electrode across said cavity in said substrate chip;

a perforated electrode spaced from said movable plate electrode and mounted across said cavity in said substrate chip; and said cavity having a depth from said movable electrode to the back wall of said cavity of approximately one quarter wavelength of an acoustic wave for enabling constructive interference between the incoming and reflected acoustic wave for maximizing the displacement of said movable electrode and the sensitivity of the microphone.

15. An integrated resonant cavity acoustic hydrophone, comprising:

a substrate chip having a cavity with a back wall;

a movable plate electrode;

means for resiliently maintaining said movable plate electrode across said cavity in said substrate chip;

a perforated electrode spaced from said movable plate electrode and mounted across said cavity in said substrate chip; and said cavity having a depth from said movable electrode to the back wall of said cavity of approximately one quarter wavelength of an acoustic wave for enabling constructive interference between the incoming and reflected acoustic wave for maximizing the displacement of said movable electrode and the sensitivity of the hydrophone.

16. An integrated resonant cavity acoustic loudspeaker, comprising:

a substrate chip having a cavity with a back wall;

a movable plate electrode;

means for resiliently mounting said movable plate electrode across said cavity in said substrate chip;

a perforated electrode spaced from said movable plate electrode and mounted across said cavity in said substrate chip; and said cavity having a depth from said movable electrode to the back wall of said cavity of approximately one quarter wavelength of an acoustic wave for enabling constructive interference between the generated and reflected acoustic wave for maximizing the displacement of the movable electrode and the acoustic output.

* * * * *